US008845051B2

(12) United States Patent
Iwata et al.

(10) Patent No.: US 8,845,051 B2
(45) Date of Patent: Sep. 30, 2014

(54) DROPLET EJECTING APPARATUS AND METHOD FOR DRIVING THE SAME

(71) Applicants: Shuusuke Iwata, Kanagawa (JP); Naoko Kitaoka, Kanagawa (JP); Satoru Tobita, Kanagawa (JP)

(72) Inventors: Shuusuke Iwata, Kanagawa (JP); Naoko Kitaoka, Kanagawa (JP); Satoru Tobita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/095,253

(22) Filed: Dec. 3, 2013

(65) Prior Publication Data

US 2014/0160193 A1 Jun. 12, 2014

(30) Foreign Application Priority Data

Dec. 7, 2012 (JP) ..... 2012-268348

(51) Int. Cl.
*B41J 29/38* (2006.01)
*B41J 2/045* (2006.01)

(52) U.S. Cl.
CPC ..... *B41J 2/04588* (2013.01)
USPC ..... 347/10

(58) Field of Classification Search
CPC ..... B41J 2/04581; B41J 2/04588; B41J 2/04596; B41J 2/04541; B41J 2/04563; B41J 2/04566
USPC ..... 347/9–11, 68, 70–72
See application file for complete search history.

(56) References Cited

U.S. PATENT DOCUMENTS

| | | | | |
|---|---|---|---|---|
| 6,575,544 | B2 * | 6/2003 | Iriguchi | 347/11 |
| 7,178,893 | B2 * | 2/2007 | Noda | 347/10 |
| 7,573,179 | B2 * | 8/2009 | Okuda | 310/315 |
| 2006/0214538 | A1 | 9/2006 | Okuda | |

FOREIGN PATENT DOCUMENTS

| | | |
|---|---|---|
| JP | 2004-066630 | 3/2004 |
| JP | 4770226 | 7/2011 |

* cited by examiner

*Primary Examiner* — An Do
(74) *Attorney, Agent, or Firm* — Cooper & Dunham LLP

(57) ABSTRACT

A droplet ejecting apparatus includes a recording head including nozzles, liquid chambers communicating with the respective nozzles and storing ink, and actuators for applying pressure to the respective liquid chambers; and a print control unit configured to generate drive signals for driving the respective actuators to eject droplets from the nozzles. The drive signal includes a first contracting waveform component for ejecting a droplet and a second contracting waveform component for further contracting the liquid chamber after application of the first contracting waveform component but not ejecting a droplet. The second contracting waveform component is output at oscillation-damping timing at which a pressure wave generated by the first contracting waveform component is damped, in a condition where an environmental temperature is high, and is output at resonating timing at which resonance with the generated pressure wave occurs, in a condition where the environmental temperature is low.

7 Claims, 11 Drawing Sheets

DROPLET EJECTING APPARATUS AND METHOD FOR DRIVING THE SAME

CROSS-REFERENCE TO RELATED APPLICATION

The present application claims priority to and incorporates by reference the entire contents of Japanese Patent Application No. 2012-268348 filed in Japan on Dec. 7, 2012.

BACKGROUND OF THE INVENTION

1. Field of the Invention

The present invention relates to a droplet ejecting apparatus and a method for driving the apparatus.

2. Description of the Related Art

In recent years, inkjet printers are desired to include a capability of stably squirting tiny droplets at a higher frequency to print a high-resolution image at a higher speed.

A phenomenon of break-off of an ejected droplet is one of causes that degrade image quality. A droplet ejected from a nozzle of a liquid ejecting head is followed by a tail (hereinafter, "satellite") extending from a meniscus of the nozzle. This satellite can break off from the droplet into flight. The satellite portion broken off from the meniscus flies as a satellite droplet (while the droplet that flies first is referred to as "principal droplet").

As the viscosity of ejected liquid increases, this satellite produced at droplet ejection increases in length. In particular, when a droplet that is small in volume (generally approximately 3 picoliters or smaller) is ejected, because a difference in dot diameter between a satellite droplet and the principal droplet is small, the satellite becomes undesirably relatively conspicuous. Presence of such a satellite droplet degrades image quality. Furthermore, satellite droplets exert a large influence on image quality particularly when a configuration that includes a plurality of heads is employed. This is because if satellite droplets are produced differently among the heads, the satellite droplets change color tone by making difference in brightness or the like.

Furthermore, other problems can also arise. For example, reading accuracy of a bar-code can deteriorate when printed with satellites. A text image can degrade in image quality (more specifically, be blurred) when printed with satellites. In a case where satellites are considerably small in volume or fly at a low velocity, the satellites are gradually diffused as mist, in which case probability of occurrence of a problem, such as internal contamination with ink of a printing apparatus where a heed(s) is mounted, increases.

Against this background, a technique related to a single-pulse drive waveform configuration P3 for suppressing satellite production at ejection of a tiny droplet is conventionally known. The waveform configuration P3 includes a first contracting waveform component r1 that causes a principal droplet to be ejected, a fixed-duration-holding waveform component d2 subsequent to the waveform component r1, and a second contracting waveform component r2 to be applied after the waveform component d2 invariably at timing application at which amplifies oscillation of a meniscus generated by the waveform component r1. This configuration amplifies a satellite without exerting an influence to velocity of a principal droplet, thereby reducing a length of the satellite.

Japanese Patent No. 4770226 discloses a technique including detecting an environmental temperature of a head, and applying to a piezoelectric element a drive waveform that is stretched or compressed in a direction of a voltage axis and a direction of a time axis depending on the detected environmental temperature. A second pulse, which is a reverberation adjusting component subsequent to an ejecting component, is optimized by changing a width or timing of the second pulse in such a manner that: the lower the environmental temperature, the more the reverberant oscillation is amplified; the higher the environmental temperature, the more the reverberant oscillation is damped.

However, the waveform configuration P3 described above is disadvantageous in the following respect. To further reduce the length of the satellite, a voltage Vr2 of the second contracting waveform component r2 can be raised, or there can be employed a waveform configuration P2+P3 by adding a plurality of ejection pulses P2 (generally at resonance intervals of Tp=1Tc) antecedent to the waveform component r2. The waveform configuration P2+P3 allows ejecting a droplet of a large liquid amount (hereinafter, "large droplet") by merging droplets ejected by the ejection pulse P2 and the satellite-shortening ejection pulse P3. The waveform configuration P2+P3 amplifies oscillation of the meniscus relative to oscillation produced by application of the pulse P3 singly. Because oscillation produced by application of the second contracting waveform component r2 is further superimposed on the oscillation, frequency characteristics degrade. In addition, unexpected unnecessary droplet can be ejected by the second contracting waveform component r2. Even when such an unintended droplet is not ejected, there arises a problem that the second contracting waveform component r2 can cause the meniscus to unnecessarily bulge and induce distortion or the like of a droplet ejected in a next period, thereby notably degrading image quality when driven at a high frequency.

Furthermore, in a high-temperature condition where residual oscillation is less prone to damp, the second contracting waveform component r2 amplifies the oscillation by a degree larger than required, thereby notably degrading image quality when driven at a high frequency as in the above. There is also another problem that, in a low-temperature condition where residual oscillation is prone to damp, effect of the satellite shortening is not obtained because residual oscillation necessary to push out a satellite portion is not produced.

To solve the problems described above, a crest value of the second contracting waveform component r2 can be lowered in a high-temperature condition. However, this causes the meniscus to be pushed less by compression of a liquid chamber and results in failure to obtain a second satellite shortening effect, which will be described later, provided by neck formation in an ink column. Furthermore, because a second expanding waveform component f2 for lowering the voltage back to an intermediate voltage is also reduced, it becomes difficult to enhance a residual-oscillation damping effect. When, on the other hand, the crest value of the waveform component r2 is increased in a low-temperature condition, the number of troubles such as ejection of an unnecessary droplet increases sharply, which leads to a problem of notable degradation in image quality as in the case described above.

Furthermore, another waveform component for damping meniscus oscillation that is amplified in a high-temperature condition or when a large droplet is ejected may be added to a trailing end of P3 to prevent degradation in frequency characteristics. However, such addition not only complicates waveform but also increases a length of the waveform, and therefore prevents increasing a printing speed.

The technique disclosed in Japanese Patent No. 4770226 is disadvantageous in that, when residual oscillation of a meniscus velocity is damped, bulge of the meniscus is also undesirably reduced and, accordingly, the satellite shortening effect to be provided by neck formation in an ink column is also lessened. Therefore, attaining both of satellite shortening and stable ejection is difficult.

Under the circumstances, there is a need for a droplet ejecting apparatus that minimizes influences on a drive waveform length and a waveform configuration, is highly stable, has favorable frequency characteristics, and is capable of ejecting droplets with fewer satellites even in a condition where an environmental temperature varies relatively greatly.

SUMMARY OF THE INVENTION

It is an object of the present invention to at least partially solve the problems in the conventional technology.

According to an embodiment, there is provided a droplet ejecting apparatus that includes a recording head including a plurality of nozzles, a plurality of liquid chambers communicating with the respective nozzles and storing ink, and actuators for applying pressure to the respective liquid chambers; and a print control unit configured to generate drive signals for driving the respective actuators to cause droplets to be ejected from the nozzles. The drive signal includes a first contracting waveform component for ejecting a droplet and a second contracting waveform component for further contracting the liquid chamber after application of the first contracting waveform component but not ejecting a droplet. The second contracting waveform component is set to be output at oscillation-damping timing at which a pressure wave generated by the first contracting waveform component is damped, in a condition where an environmental temperature is high. The second contracting waveform component is set to be output at resonating timing at which resonance with the pressure wave generated by the first contracting waveform component occurs, in a condition where the environmental temperature is low.

According to another embodiment, there is provided a method for driving a droplet ejecting apparatus that includes a recording head including a plurality of nozzles, a plurality of liquid chambers communicating with the respective nozzles and storing ink, and actuators for applying pressure to the respective liquid chambers, and a print control unit configured to generate drive signals for driving the respective actuators to cause droplets to be ejected from the nozzles. The method includes outputting a first contracting waveform component for ejecting a droplet as a component of the drive signal; and outputting a second contracting waveform component for further contracting the liquid chamber after application of the first contracting waveform component but not ejecting a droplet, as a component of the drive signal. The second contracting waveform component is output at oscillation-damping timing at which a pressure wave generated by the first contracting waveform component is damped, in a condition where an environmental temperature is high. The second contracting waveform component is output at resonating timing at which resonance with the pressure wave generated by the first contracting waveform component occurs, in a condition where the environmental temperature is low.

The above and other objects, features, advantages and technical and industrial significance of this invention will be better understood by reading the following detailed description of presently preferred embodiments of the invention, when considered in connection with the accompanying drawings.

DETAILED DESCRIPTION CF THE PREFERRED EMBODIMENTS

An exemplary embodiment of the present invention is described in detail below with reference to the accompanying drawings.

Figure 1:
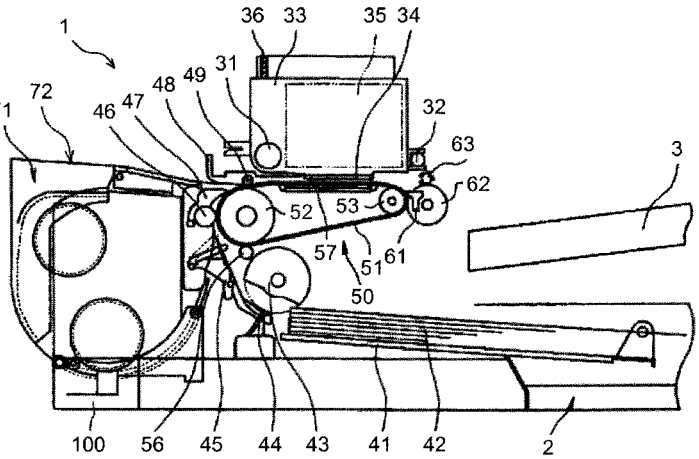
FIG. 1 is a side view illustrating an overall configuration of an image forming apparatus according to an embodiment.
Figure 2:
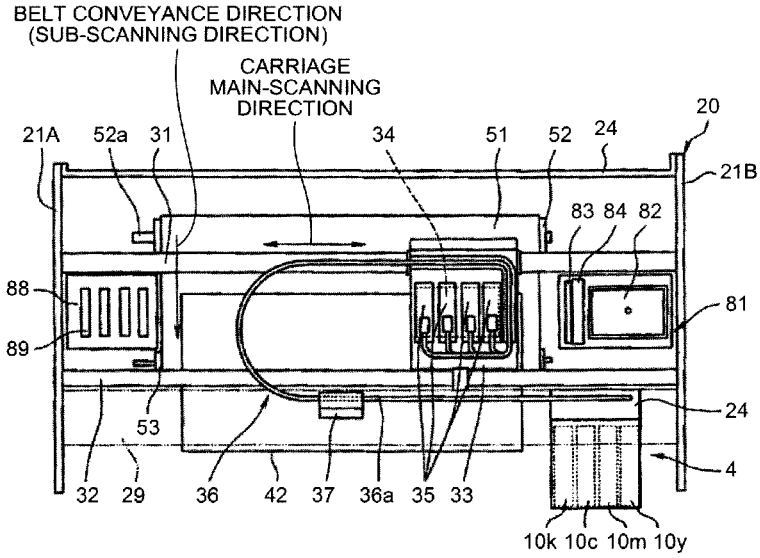
FIG. 2 is a plan view of a relevant portion of the image forming apparatus according to the embodiment.

An image forming apparatus according to an embodiment of the present invention is described below with reference to FIGS. 1 and 2. FIG. 1 is a side view illustrating an overall configuration of the image forming apparatus according to the embodiment. FIG. 2 is a plan view of a relevant portion of the image forming apparatus according to the embodiment.

The image forming apparatus is a serial inkjet recording apparatus and includes a carriage 33 slidably supported on a main guide rod 31 and a sub guide rod 32, which are guide members horizontally laid across and supported on side plates 21A and 21B on left and right sides of an apparatus body 1. The guide rods 31 and 32 allow the carriage 33 to slide in the main-scanning direction. The carriage 33 is moved by a main-scanning motor (not shown) via a timing belt to scan in the direction (carriage main-scanning direction) indicated by an arrow in FIG. 2.

The carriage 33 includes thereon a recording head 34 that includes liquid ejection heads for ejecting ink droplets of different colors, which are yellow (Y), cyan (C), magenta (M), and black (K). The recording head 34 is mounted on the carriage 33 such that nozzle lines, each of which is made up of a plurality of nozzles, lie along the sub-scanning direction perpendicular to the main-scanning direction, and oriented so as to eject the ink droplets downward.

The recording head 34 includes four nozzle lines that eject black (K) ink droplets, cyan (C) ink droplets, magenta (M) ink droplets, and yellow (Y) ink droplets, respectively. The recording head 34 may alternatively be configured to include a single nozzle face on which the nozzle lines, each of which made up of a plurality of nozzles, for the respective colors are arranged.

The carriage 33 includes thereon sub tanks 35 serving as a second ink supplying unit for supplying inks of the respective colors to the corresponding nozzle lines of the recording head 34. Recording liquids of the respective colors are supplied by a supply pump unit 24 to the sub tanks 35 from ink cartridges (main tanks) 10*y*, 10*m*, 10*c*, and 10*k* for the respective colors via supply tubes 36 for the respective colors. The ink cartridges 10*y*, 10*m*, 10*c*, and 10*k* are detachably mounted on a cartridge holder unit 4.

The image forming apparatus includes a sheet feeding unit for feeding media sheets 42 placed on a sheet loading unit (pressurizing plate) 41 of a sheet feed tray 2. The sheet feeding unit includes a semicircular roller (sheet feed roller) 43 that picks up and feeds the sheets 42 from the sheet loading unit 41 one sheet by one sheet, and a separating pad 44 arranged to face the sheet feed roller 43 and made of a material having a high coefficient of friction.

The image forming apparatus further includes a guide member 45 for guiding the sheet 42, a counter roller 46, a conveyance guide member 47, and a pressing member 48 that includes a leading-end pressing roller 49. These members are for use in delivering the sheet 42 fed from the sheet feeding unit to below the recording head 34. The image forming apparatus also includes a conveying belt 51 that electrostatically attracts the fed sheet 42 and conveys the sheet 42 through an area where the sheet 42 faces the recording head 34.

The conveying belt 51 is an endless belt wound around and stretched between a conveying roller 52 and a tension roller 53. The conveying belt 51 is configured to revolve in a belt conveyance direction (the sub-scanning direction). The image forming apparatus further includes a charging roller 56 serving as a charging unit that electrostatically charges a surface of the conveying belt 51.

The charging roller 56 is arranged so as to come into contact with a surface layer of the conveying belt 51 to be rotated by revolving motion of the conveying belt 51. The conveying belt 51 is revolved in the belt conveyance direction illustrated in FIG. 2 via timing by rotation of the conveying roller 52 that is driven to rotate by a sub-scanning motor (not shown).

The image forming apparatus further includes a sheet discharging unit for discharging the sheet 42 undergone recording performed by the recording head 34. The sheet discharging unit includes a separation claw 61, a sheet discharging roller 62, a spur 63 serving as a sheet discharging roller, and a sheet output tray 3. The separation claw 61 is for separating the sheet 42 from the conveying belt 51. The sheet output tray 3 is at a position lower than the sheet discharging roller 62.

The image forming apparatus also includes a duplex printing unit 71 detachably mounted on a back portion of the apparatus body 1. The duplex printing unit 71 receives the sheet 42 that is moved backward by reverse revolving motion of the conveying belt 51, turns upside down the sheet 42, and then delivers the sheet 42 to a nip between the counter roller 46 and the conveying belt 51. A top surface of the duplex printing unit 71 is configured as a bypass tray 72.

The image forming apparatus further includes a maintenance/recovery mechanism (service station) 81 for maintaining and recovering a state of the nozzles of the recording head 34. The maintenance/recovery mechanism 81 is in a non-printing area at one end of the carriage 33 in the scanning direction. The maintenance/recovery mechanism 81 includes cap members (hereinafter, "caps") 82 for capping the nozzle faces of the recording head 34, a wiper member (wiper blade) 83 for wiping the nozzle faces, an idle ejection receiver (spitting receiver) 84 for receiving droplets ejected as idle ejection (spitting), and a carriage lock for locking the carriage 33. The idle ejection is performed to discharge thickened recording liquid by ejecting droplets irrelevantly to recording.

A waste ink reservoir 100 for storing therein waste ink produced by a maintenance/recovery operation is also detachably mounted on the apparatus body at a position below the maintenance/recovery mechanism 81. The image forming apparatus further includes the idle ejection receiver 84 for receiving droplets ejected as the idle ejection in a non-printing area at the other end of the carriage 33 in the scanning direction. The idle ejection is performed to discharge thickened recording liquid by ejecting droplets irrelevantly to recording. The idle ejection receiver 88 has openings 89 or the like along the nozzle lines of the recording head 34.

In the image forming apparatus configured as described above, the sheets 42 are picked up and fed from the sheet feed tray 2 one sheet by one sheet. The sheet 42 fed substantially upward is guided by the guide 45 and conveyed by being pinched between the conveying belt 51 and the counter roller 46. The sheet 42 is further guided at its leading end by a conveyance guide member 47 and pressed by the leading-end pressing roller 49 against the conveying belt 51. Thus, the conveying direction of the sheet 42 is turned approximately 90 degrees.

At this time, positive and negative voltages are alternately applied or, in short, alternating voltages are applied, to the charging roller 56. Accordingly, the conveying belt 51 is electrostatically charged in a pattern made up of alternating positively-charged and negatively-charged zones each having a predetermined width and alternating in the sub-scanning direction or, in other words, the revolving direction of the conveying belt 51.

When the sheet 42 is fed onto the conveying belt 51 that is alternately positively and negatively charged, the sheet 42 is attracted onto the conveying belt 51. The sheet 42 is then conveyed in the sub-scanning direction as the conveying belt 51 revolves.

One line of an image is recorded on the sheet 42 by driving the recording head 34 to eject ink droplets onto the sheet 42 that is at rest according to image signals while moving the carriage 33. After the sheet 42 is conveyed a predetermined amount, a next line is recorded on the sheet 42. When a recording completion signal or a signal indicating that a trailing end of the sheet 42 has reached a recording area is received, the recording operation ends. The sheet 42 is discharged onto the sheet output tray 3.

When maintenance/recovery of the nozzles of the recording head 34 is to be performed, the carriage 33 is moved to a home position where the carriage 33 faces the maintenance/recovery mechanism 81. At the home position, a maintenance/recovery operation such as nozzle purge of capping the nozzles with the cap members 82 and then sucking liquid from the nozzles or the idle ejection of ejecting droplets irrelevantly to image formation is performed. The maintenance/recovery allows image forming to be performed with stable droplet ejection.

Figure 3:
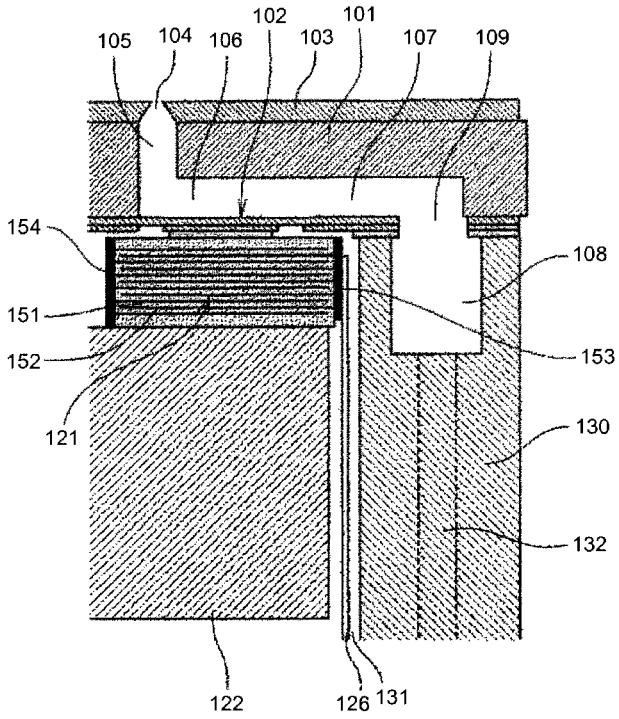
FIG. 3 is a cross-sectional view illustrating a configuration of a liquid chamber of a liquid ejecting head taken along a longitudinal direction of the liquid chamber.
Figure 4:
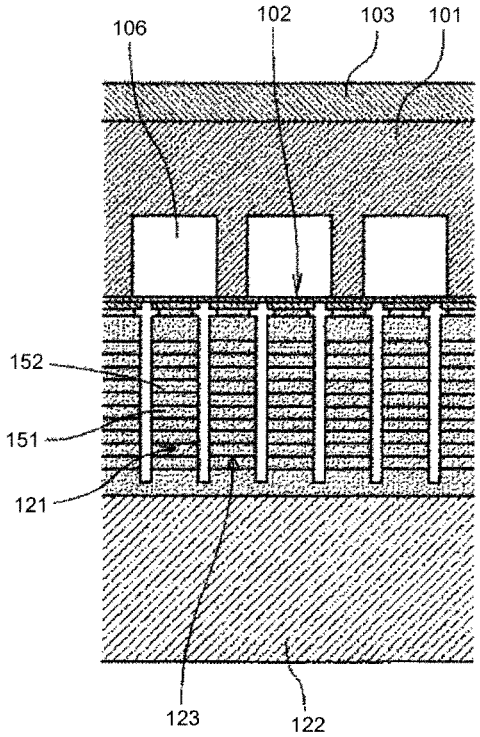
FIG. 4 is a cross-sectional view illustrating the configuration of the liquid chamber of the liquid ejecting head taken along a transverse direction of the liquid chamber.

An example of the liquid ejection head included in the recording head 34 is described below with reference to FIGS. 3 and 4. FIG. 3 is a cross-sectional view illustrating a configuration of a liquid chamber of the liquid ejecting head taken along a longitudinal direction of the liquid chamber. FIG. 4 is a cross-sectional view illustrating the configuration of the liquid chamber of the liquid ejecting head taken along a transverse direction of the liquid chamber.

The liquid ejecting head includes a channel plate 101, a diaphragm 102, and a nozzle plate 103 that are laminated by bonding the diaphragm 102 to a bottom surface of the channel plate 101 and bonding the nozzle plate to a top surface of the channel plate 101. The channel plate 101 is formed by anisotropically etching a single-crystal silicon substrate, for example. The diaphragm 102 is formed by electroforming nickel, for example. A nozzle communicating channel 105 with which a nozzle 104 that ejects an droplet (ink droplet) communicates, a liquid chamber 106, and an ink supply port 109 are defined in or by the nozzle plate 103, the channel plate 101, and the diaphragm 102. The liquid chamber 106 is a pressure generating chamber. The ink supply port 109 communicates with a common liquid chamber 108 for supplying ink to the liquid chamber 106 via a fluidic resistance portion (supply channel) 107.

The liquid ejecting head also includes two stacks of piezoelectric elements 121 (only one stack is illustrated in FIG. 3) and a base substrate 122 to which the piezoelectric elements 121 are bonded and fixed. The piezoelectric elements 121 serve as an electromechanical transducer which is a pressure generating unit (actuator) that deforms the diaphragm 102 to apply a pressure to ink inside the liquid chamber 106. Strut portions 123 are interposed between the piezoelectric elements 121.

The strut portions 123 are formed by dividing and processing a piezoelectric material simultaneously when the piezoelectric elements 121 are formed from the piezoelectric material. In a conventional technique, the strut portions 123 serve only as struts because a driving voltage is not applied thereto. The piezoelectric elements 121 are connected to a flexible printed circuit (FPC) cable 126 including thereon a driver circuit (a driver IC) (not shown).

A peripheral portion of the diaphragm 102 is bonded to a frame member 130. A cavity serving as a through hole portion 131 for accommodating an actuator unit, a cavity serving as the common liquid chamber 108, and an ink supply hole 132, through which ink is to be supplied from outside to the common liquid chamber 108, are defined in the frame member 130. The actuator unit includes the piezoelectric elements 121 and the base substrate 122.

The frame member 130 is formed by, for example, injection molding a thermosetting resin such as an epoxy resin or polyphenylene sulfide. Cavities and holes serving as the nozzle communicating channel 105 and the liquid chamber 106 are defined in the channel plate 101 by anisotropically etching a single-crystal silicon substrate having a (110) crystal plane orientation using an alkaline etchant such as a potassium hydroxide (KOH) aqueous solution. However, the material of the channel plate 101 is not limited such a single-crystal silicon substrate; the channel plate 101 may be formed of other material, such as a stainless substrate or a photosensitive resin.

The diaphragm 102 is made from a metal plate of nickel and produced by, for example, electroforming. Alternatively, the diaphragm 102 may be made from another metal plate, a member formed by joining a metal and a resin plate together, or the like.

The piezoelectric elements 121 and the strut portions 123 are bonded with adhesive to the diaphragm 102, to which the frame member 130 is also bonded with adhesive. The nozzle plate 103, in which the nozzles 104 that are 10 to 30 μm in diameter and respectively associated with the liquid chambers 106 are defined, is bonded to the channel plate 101 with adhesive. The nozzle plate 103 is formed by depositing one or more layers as required on a surface of a metal member, in which the nozzles are defined, and laminating an uppermost surface with a water-repellent layer.

The piezoelectric element 121 is a stacked piezoelectric element (in this example, lead zirconate titanate (PZT)) formed by alternately stacking piezoelectric materials 151 and internal electrodes 152. An individual electrode 153 and a common electrode 154 are connected to each of the internal electrodes 152 that extend alternately to different end faces of the piezoelectric element 121.

In the embodiment, the piezoelectric element 121 is configured to apply a pressure to ink in corresponding one of the liquid chambers 106 using displacement in d33 mode as the piezoelectric direction. However, the piezoelectric element 121 may alternatively be configured to apply a pressure to ink in the liquid chamber 106 using displacement in d31 mode as the piezoelectric direction as well. A configuration, in which a single stack of the piezoelectric element 121 is arranged on a single piece of the substrate 122, may be employed.

In the liquid ejection head configured as described above, the piezoelectric element 121 contracts when, for instance, a voltage applied to the piezoelectric element 121 is lowered from a reference voltage. As a result, the diaphragm 102 descends, which in turn increases a volumetric capacity of the liquid chamber 106, causing ink to flow into the liquid chamber 106. Thereafter, the voltage applied to the piezoelectric element 121 is raised to expand the piezoelectric element 121 in the stack direction to deform the diaphragm 102 toward the nozzles 104, thereby compressing the capacity/volume of the liquid chamber 106. As a result, the ink inside the liquid chamber 106 is pressurized, and an ink droplet is ejected (squirted) from the nozzle 104.

When the voltage applied to the piezoelectric element 121 is returned back to the reference voltage, the diaphragm 102 is restored to its initial position, and the liquid chamber 106 expands. As a result, a negative pressure is developed, causing the liquid chamber 106 to be refilled with ink supplied from the common liquid chamber 108.

After oscillation of a meniscus surface of the nozzle 104 is damped and becomes stable, the liquid ejection head shifts to an operation for next droplet ejection. Meanwhile, the method for driving the head is not limited to the example (pull-and-push ejection) described above. Another head driving method, such as pull-ejection or push-ejection, can be employed by changing a drive waveform to be applied.

Figure 5:
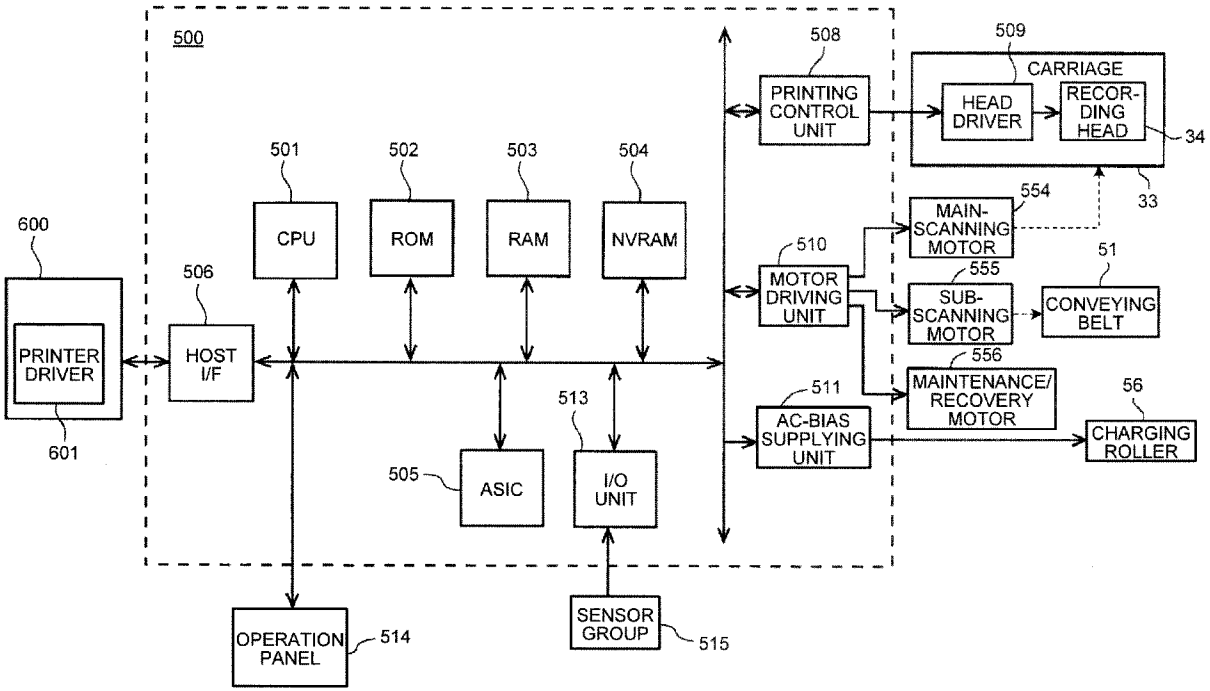
FIG. 5 is a block diagram illustrating a control system of the image forming apparatus according to the embodiment.

An outline of a control unit of the image forming apparatus is described below with reference to FIG. 5. FIG. 5 is a block diagram illustrating a control system of the image forming apparatus according to the embodiment.

A control unit 500 includes a central processing unit (CPU) 501 for controlling the entire image forming apparatus, a read only memory (ROM) 502 for storing program instructions to be executed by the CPU 501 and other fixed data a random access memory (RAM) 503 for temporarily storing image data and the like, a nonvolatile memory 504 for holding data even while power supply of the apparatus is shut off, and an application specific integrated circuit (ASIC) 505. The CPU 501 also serves as a unit that controls the idle ejection according to the embodiment. The ASIC 505 processes input/output signals for various signal processing performed on image data, image processing such as sorting, and for overall control of the apparatus.

The control unit 500 further includes a printing control unit 508, a head driver (driver IC) 509, a motor driving unit 510, and an AC-bias supplying unit 511. The printing control unit 508 includes a data transfer unit and a drive-signal generating unit for driving and controlling the recording head 34. The head driver 509 for driving the recording head 34 is arranged on the carriage 33. The motor driving unit 510 drives a main-scanning motor 554 that moves the carriage 33 in a scanning manner, a sub-scanning motor 555 that causes the conveying belt 51 to revolve, and a maintenance/recovery motor 556 of the maintenance/recovery mechanism 81. The AC-bias supplying unit 511 supplies an AC bias to the charging roller 56.

The control unit 500 is connected to an operation panel 514 for use in inputting and displaying information necessary for the image forming apparatus. The control unit 500 further includes a host interface (I/F) 506 for transmitting/receiving data and signals to and from a host. The control unit 500 receives data and signals at the host I/F 506 via a cable or a network from a host 600 that can be an information processing apparatus such as a personal computer, an image reading apparatus such as an image scanner, or an imaging apparatus such as a digital camera.

The CPU 501 of the control unit 500 reads out print data from a receive buffer of the I/F 506, analyzes the print data, causes the ASIC 505 to perform necessary processing such as image processing and data sorting to obtain image data, and causes the image data to be transferred via the printing control unit 508 to the head driver 509. Meanwhile, dot pattern data for use in image output is generated by a printer driver 601 on the host 600.

The printing control unit 508 serially transfers the thus-obtained image data and, in addition, outputs a transfer clock, a latch signal, a control signal, and the like that are necessary for transferring and committing the transfer of the image data to the head driver 509. Furthermore, the printing control unit 508 that includes a drive-signal generating unit that includes a D/A converter that performs D/A conversion of pattern data of drive pulses stored in the ROM, a voltage amplifier, and a current amplifier outputs a drive signal made up of one or more drive pulses to the head driver 509.

The head driver 509 drives the recording head 34 by selectively applying the drive pulse(s) contained in the drive signal fed from the printing control unit 508 based on the serially-input image data, which corresponds to one line for the recording head 34, to a drive element (e.g., a piezoelectric element) that generates energy for causing a droplet to be ejected from the recording head 34. In this process, it is possible to eject a droplet of a desired size selected from, for example, a large-size droplet, a medium-size droplet, and a small-size droplet by selecting the drive pulse(s) contained in the drive signal accordingly.

An input-output (I/O) unit 513 acquires information from a sensor group 515 made up of various sensors mounted on the apparatus, extracts information necessary for printer control, and uses the information in controlling the printing control unit 508, the motor driving unit 510, and the AC-bias supplying unit 511.

The sensor group 515 includes an optical sensor for detecting a position of a sheet, a thermistor for monitoring a temperature in the apparatus, a sensor for monitoring the voltage of the electrostatic charging belt, and an interlock switch for detecting an open/close state of a cover. The I/O unit 513 is capable of processing various sensor information.

Figure 6:
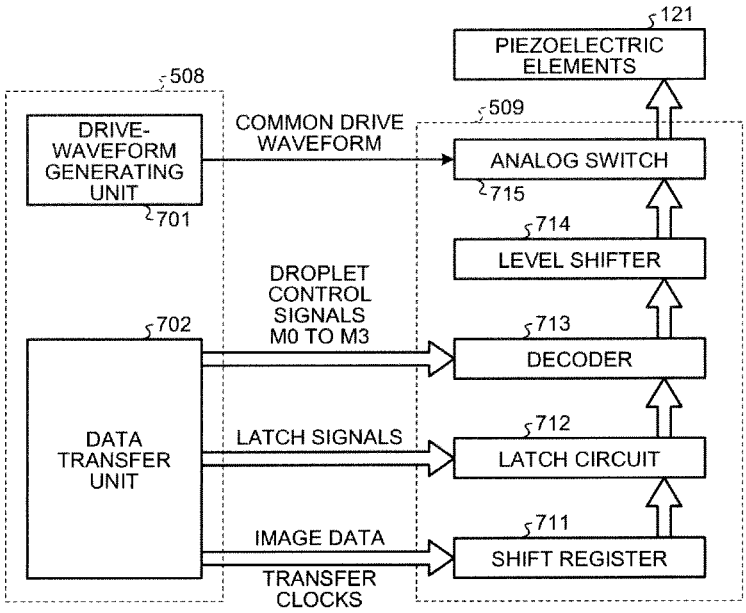
FIG. 6 is a block diagram illustrating a head-driving control system according to the embodiment.

An example of the printing control unit 508 and the head driver 509 is described below with reference to FIG. 6. FIG. 6 is a block diagram illustrating a head-driving control system according to the embodiment.

As described above, the printing control unit 508 includes a drive-waveform generating unit 701 and a data transfer unit 702. The drive-waveform generating unit 701 generates and outputs a drive waveform (common drive waveform) that contains, in a single printing period, a plurality of drive pulses (drive signals) when an image is to be formed. The drive-waveform generating unit 701 also generates and outputs an idle-ejection drive waveform that contains, in a single idle-ejection drive period, a plurality of idle-ejection drive pulses (drive signals) when the idle ejection is to be performed. The data transfer unit 702 outputs 2-bit image data (gray-scale signals of 0s and 1s) corresponding to a to-be-printed image, clock signals, latch signals (LAT), and droplet control signals M0 to M3.

Meanwhile, the droplet control signal is a 2-bit signal that instructs an analog switch 715, which is a switching unit to be described later of the head driver 509, to switch on and off on a droplet-by-droplet basis. The droplet control signal transits to a high (H) (ON) state for a waveform to be selected in accordance with the printing period of the common drive waveform, but transits to a low (L) (OFF) state for a waveform that is not to be selected.

The head driver 509 includes a shift register 711, a latch circuit 712, a decoder 713, a level shifter 714, and the analog switch 715. The shift register 711 receives inputs of a transfer clock (shift clock) and serial image data (gray-scale data of 2 bits per channel (per nozzle)) transferred from the data transfer unit 702. The latch circuit 712 latches register values pertaining to the shift register 711 according to the latch signals. The decoder 713 decodes the gray-scale data and the droplet control signals M0 to M3 and outputs a decoding result. The level shifter 714 converts logic-level voltage signals output from the decoder 713 to levels at which the analog switch 715 is operable. The analog switch 715 is operated on and off (to open and close) according to the decoding result output from the decoder 713 and fed to the analog switch 715 via the level shifter 714.

The analog switch 715 is connected to the selection electrode (individual electrode) 153 of each of the piezoelectric elements 121 and receives an input of the common drive waveform from the drive-waveform generating unit 701. The analog switch 715 is switched on according to the result of decoding, which is performed by the decoder 713, of the serially-transferred image data (gray-scale data) and the droplet control signals M0 to M3. As a result, desired drive signal(s), which is contained in the common drive waveform, passes through (i.e., is selected) to be applied to the piezoelectric element 121.

Figure 7:
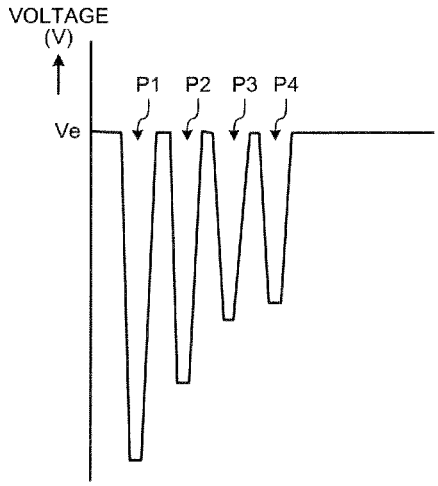
FIG. 7 is a configuration diagram of a representative drive signal for driving the liquid ejecting head.

The ejection drive pulse (common drive waveform) is described below with reference to FIG. 7. FIG. 7 is a configuration diagram of a representative drive signal for driving the liquid ejecting head.

The drive-waveform generating unit 701 generates and outputs an ejection drive signal (drive waveform) containing a plurality of (in this example, four) drive pulses P1 to P4 in a single idle ejection period (single drive period). As illustrated in FIG. 7, the drive pulse includes a waveform component that falls from a reference voltage Ve, a waveform component that holds a hold state (portion where the voltage remains the same) after the voltage has fallen, and a waveform component that rises from the hold state.

The waveform component that drops a voltage V of the drive pulse from the reference voltage Ve is a pull-in waveform component that contracts the piezoelectric element 121 to thereby increase a volumetric capacity of the pressurizing liquid chamber 106. The waveform component that rises from the fallen state is a pressurizing waveform component that elongates the piezoelectric element 121 to thereby compress the volumetric capacity of the pressurizing liquid chamber 106.

Figure 8:
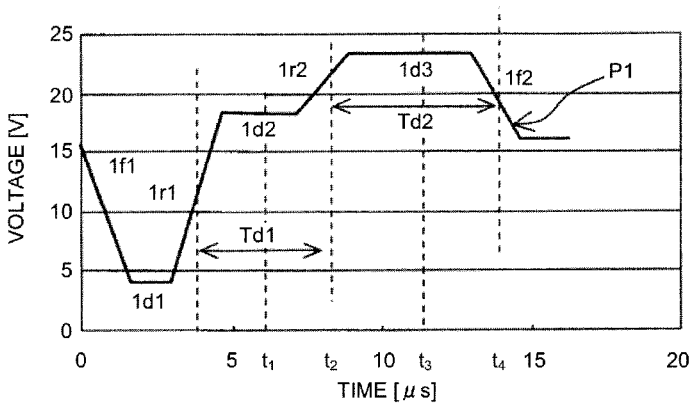
FIG. 8 is a configuration diagram of a drive waveform according to a first implementation example.

FIG. 8 illustrates a waveform P1, which is a waveform of a single pulse of the ejection drive pulse illustrated in FIG. 7, of a first implementation example. FIG. 8 is a configuration diagram of the drive waveform according to the first implementation example. (Hereinafter, an acoustic natural period of the liquid chamber 106 is denoted by Tc; it is assumed hereinafter as: Tc=5.0 (microseconds (μs)) unless otherwise specified; Tf and Tr, which is time of a rising/falling component of each waveform, is assumed as: Tf=1 (μs), Tr=1 (μs).)

Figure 11:
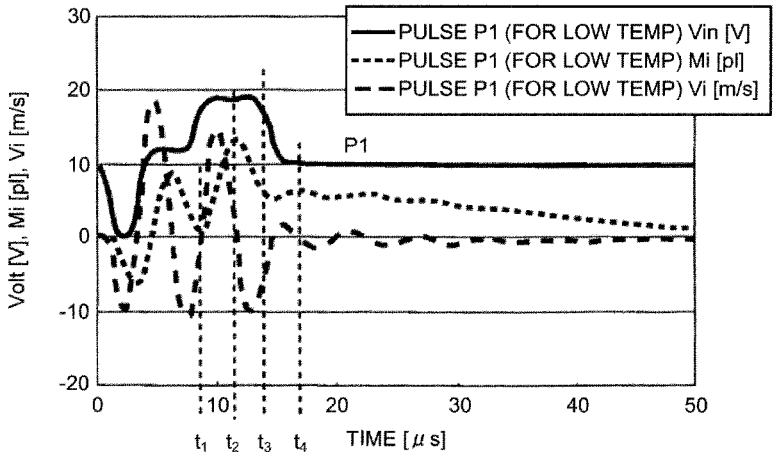
FIG. 11 is a diagram illustrating a drive waveform (for low temperature) according to the first implementation example and simulation results of position and velocity of a meniscus upon application of the waveform.
Figure 12:
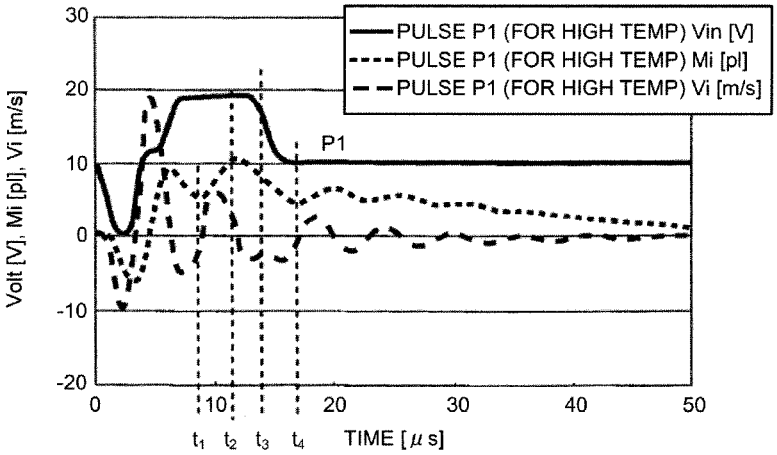
FIG. 12 is a diagram illustrating a drive waveform (for high temperature) according to the first implementation example and simulation results of position and velocity of a meniscus upon application of the waveform.

FIGS. 11 and 12 illustrate displacement and velocity of a meniscus 804 upon application of the waveform P1. FIG. 11 is a diagram illustrating a drive waveform (for low temperature) according to the first implementation example and simulation results of position and velocity of the meniscus upon application of the waveform. FIG. 12 is a diagram illustrating a drive waveform (for high temperature) according to the first implementation example and simulation results of position and velocity of the meniscus upon application of the waveform.

As illustrated in FIG. 8, the waveform P1 includes a first expanding waveform component 1*f*1 for generating in advance a pressure wave for droplet ejection, a first holding waveform component 1*d*1, a first contracting waveform component 1*r*1 for causing a droplet to be ejected in synchronization with the pressure wave generated by the waveform component 1*f*1, a second holding waveform component 1*d*2, and a second contracting waveform component 1*r*2 that is of an intensity insufficient to eject a droplet.

Application timing of 1*r*2 is set as follows. The lower the environmental temperature, the closer the application timing to a time, at which the pressure wave in the liquid chamber generated by 1*r*1 (i.e., when a velocity of a meniscus maximizes) is maximized or, in other words, to a time when Td1=n*Tc holds. At a time when N approaches a natural number (near $t_2$ in FIGS. 9 and 10), the higher the environmental temperature, the closer the application timing to a time, at which the pressure wave in the liquid chamber generated by 1*r*1 (i.e., maximizes a velocity of the meniscus) is maximized or, in other words, to a time when Td1=(n−½)*Tc holds. Meanwhile, N is a value close to a natural number and assumed as N=1 by taking a waveform length and a loss of effect due to damping into consideration.

In the first implementation example, more specifically, the high-temperature environment is 34° C., at which an ink viscosity is 5.5 millipascal seconds (mPas); the low-temperature environment is 14° C., at which the ink viscosity is 13 mPas.

Figure 9:
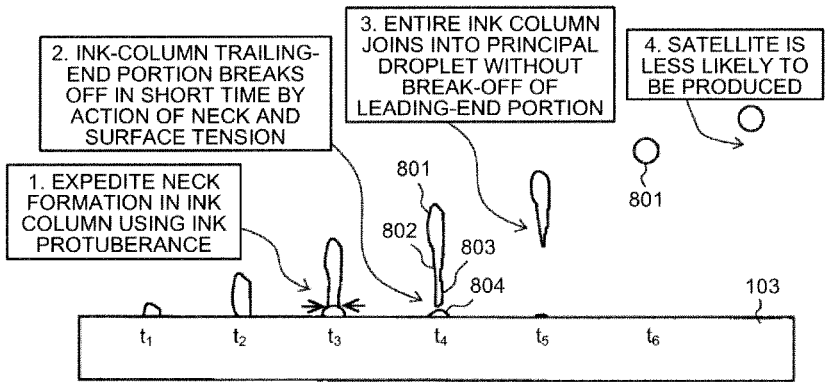
FIG. 9 is a diagram illustrating a first satellite suppressing mechanism according to the first implementation example.
Figure 10:
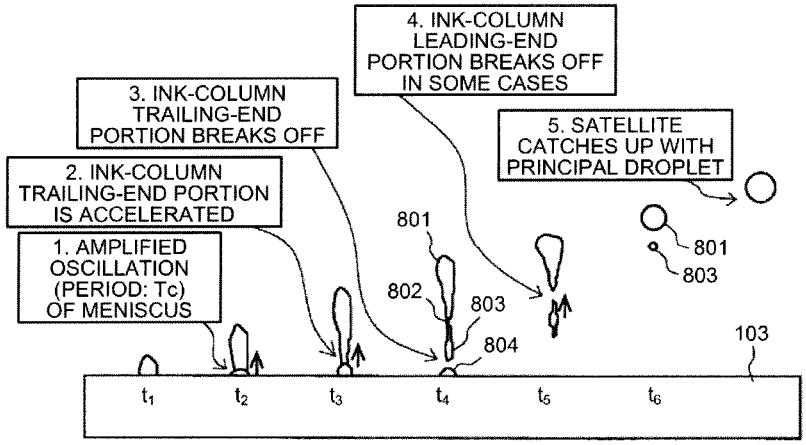
FIG. 10 is a diagram illustrating a second satellite suppressing mechanism according to the first implementation example.

Attaining both of satellite shortening and stable ejection according to the first implementation example is described below with reference to FIGS. 9 to 12. FIG. 9 is a diagram illustrating a first satellite suppressing mechanism according to the first implementation example. FIG. 10 is a diagram illustrating a second satellite suppressing mechanism according to the first implementation example. The satellite shortening effect includes a first effect and a second effect, which are described below.

The first effect is satellite shortening achieved by accelerating an ink-column trailing-end portion. As illustrated in FIG. 9, if the meniscus 804 is not bulged at a time when an ink column 802 breaks off, when a velocity of the meniscus (hereinafter, "second-time meniscus velocity") oscillating second time-around as residual oscillation decreases from a positive maximum value ($t_3$ to $t_4$), the ink column 802 is thinned abruptly. As a result, a trailing end portion 803 of the ink column 802 breaks off from the meniscus 804.

The ejected trailing end portion 803 travels at a velocity equal to the meniscus velocity at break-off of the trailing end portion 803. Accordingly, by increasing the positive maximum value of the second-time meniscus velocity or, in other words, by amplifying the residual oscillation, the trailing end portion is accelerated, and satellite shortening is achieved. For this reason, the first effect largely depends on the velocity of the meniscus during the residual oscillation.

The second effect is satellite shortening achieved by expediting break-off of the trailing-end portion by using neck formation in an ink column as a trigger. As illustrated in FIG. 10, if the meniscus is brought to a bulged state at a second-time meniscus velocity near its positive maximum, surface tension of the bulged meniscus 804 forms a neck between the meniscus 804 and the ink column 802. As a result, the ink-column trailing-end portion 803 breaks off earlier than when only the first effect is provided, and satellite shortening is achieved. For this reason, the second effect largely depends on displacement of the meniscus rather than the velocity of the same.

Figure 16:
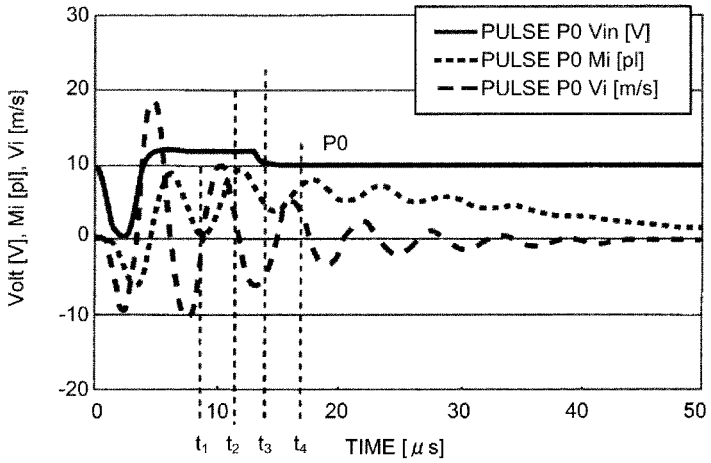
FIG. 16 is a diagram illustrating a drive waveform according to the conventional technique and simulation results of position and velocity of a meniscus upon application of the waveform.

FIG. 16 is a diagram illustrating a drive waveform P0, according to a conventional technique, that does not contain the waveform component 1*r*2 and simulation results of velocity and displacement of a meniscus upon application of the waveform P0. FIG. 16 indicates about meniscus displacement that, after application of the waveform P0, not only a Helmholtz wave of which period is To (=5 (μs)) but also a refilling wave having a frequency of approximately 10 μs and maximizing at approximately 20 μs are excited.

Figure 15:
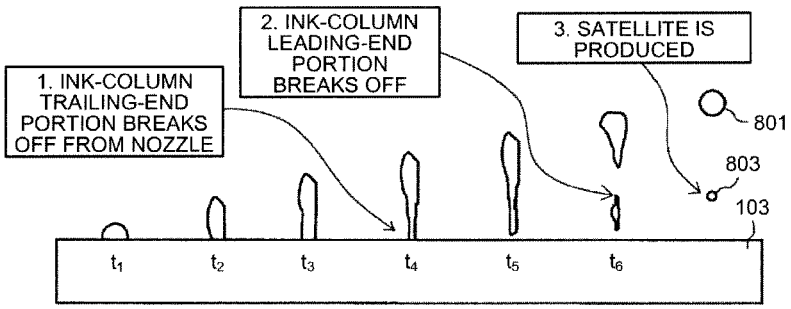
FIG. 15 is a diagram illustrating a mechanism of how a satellite is produced according to a conventional technique.

FIG. 15 illustrates a mechanism of how a satellite is produced upon application of the waveform P0. FIG. 9 is a diagram illustrating the first satellite suppressing mechanism by application of the waveform P1, which is the waveform according to the first implementation example. FIG. 11 illustrates simulation results of velocity and displacement of a meniscus upon application of the waveform P1. Generally, as illustrated in FIG. 15, the satellite droplet 803 is produced as follows. The ink-column trailing-end portion 803 breaks off from the meniscus 804, and thereafter a principal droplet 801 breaks off from the ink column. As a result, the ink-column trailing-end portion becomes a droplet independent of the principal droplet.

The ejected ink-column trailing-end portion 803 travels at a velocity equal to a meniscus velocity at break-off of the trailing end portion 803. The ink-column trailing-end portion 803 generally breaks off from the meniscus 804 at near $t_3$. Accordingly, when 1*r*2 is applied at resonating timing as in the waveform P1, a maximum value of the second-time meniscus velocity increases as illustrated in FIG. 11. Put another way, amplifying the residual oscillation accelerates the ink-column trailing-end portion as illustrated in FIG. 9; as a result, satellite shortening is achieved.

However, because such a short-period wave as the Helmholtz wave is susceptible to influence of viscous damping, the amplitude of the short-period wave increases with the temperature, and vice versa. Accordingly, in the low-temperature condition where the ink column less easily breaks off and, in addition, the Helmholtz wave damps greatly because the ink viscosity is high, it is difficult to obtain the satellite shortening effect.

In consideration of these, a crest value of 1*r*2 can be increased to enhance the satellite shortening effect. However, if the crest value is high in a high-temperature condition, oscillation excitation by 1*r*2 makes residual oscillation too wild and exerts an adverse effect on subsequent ejection. In a worst case, the residual oscillation can cause an unintended droplet to be ejected at a considerably slow velocity at a time when second-time meniscus displacement maximizes, by which various troubles such as nozzle contamination or nozzle failure can be caused. To prevent such troubles, it is conceivable to simply lower 1*r*2 of a high-temperature waveform. However, in this case, the second satellite shortening effect is also reduced, undesirably making the satellite shortening effect substantially ineffective.

Against the backdrop, the first implementation example employs the waveform P1 illustrated in FIG. 11 as a waveform for the low-temperature condition (hereinafter, "low-temperature waveform"), and the waveform P1 illustrated in FIG. 12 as a waveform for the high-temperature condition (hereinafter, "high-temperature waveform"). More specifically, the low-temperature waveform is configured such that, after application of 1*r*1 which is an ejection component, 1*r*2 is applied at resonating timing, and 1f2 is applied at oscillation-damping timing. Accordingly, the length of satellite is reduced intensively by (the first effect)+(the second effect), and thereafter oscillation is damped by an appropriate degree.

The oscillation-damping timing denotes timing which allows damping residual oscillation of the meniscus and also obtaining an appropriate degree of the satellite shortening effect by causing the meniscus 804 to bulge so that a neck is formed in the ink column 802, thereby expediting break-off of the ink-column trailing-end portion 803.

The high-temperature waveform is configured such that, after application of 1*r*1 which is the ejection component, both of 1*r*2 and 1*f*2 are applied at oscillation-damping timing. Because the second effect provides an appropriate degree of the satellite shortening effect and intensive oscillation-damping effect, it becomes possible to achieve a favorable balance between satellite shortening and stable ejection in both of the high-temperature environment and the low-temperature environment.

An intermediate-temperature waveform can be obtained by continuously changing Td1 on an assumption that temperature characteristics are continuous.

The configuration described above allows providing a drive waveform that allows suppressing influence on a drive waveform length, performing ejection stably even when driven at a high frequency, having favorable frequency characteristics, and ejecting droplets with fewer satellites throughout a relatively-wide temperature range without requiring a complicated waveform configuration.

Figure 13:
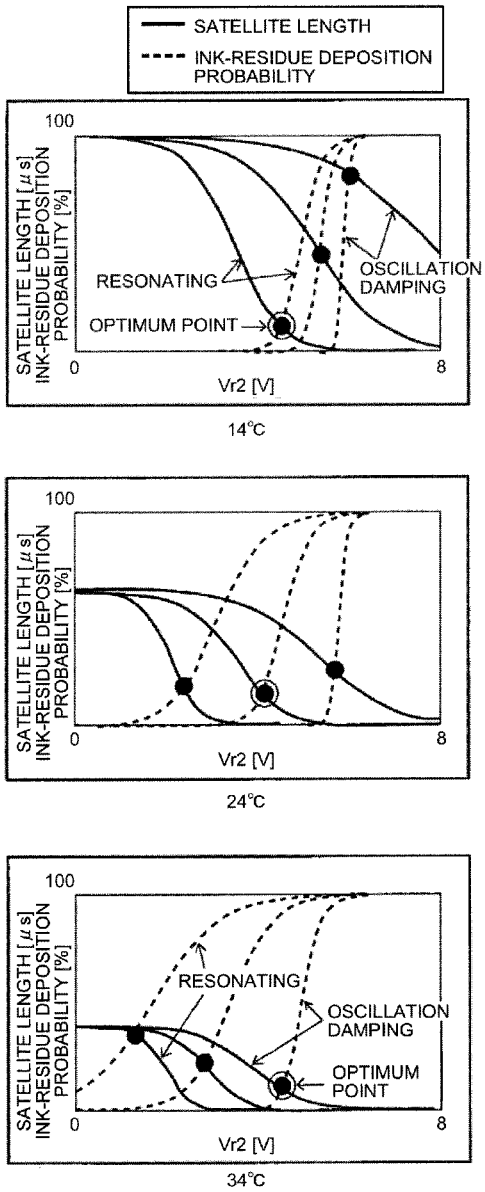
FIG. 13 is a set of characteristic graphs of satellite length and ink-residue deposition probability at different environmental temperatures according to the first implementation example.

Ejection characteristics exhibited upon application of the waveform P1 of the first implementation example to an actual head (Tc=3 (μs)) at different temperatures are described below. FIG. 13 illustrates relationship between satellite length and probability that an ink residue will be produced (hereinafter, "ink-residue deposition probability") at different crest values Vr2 of 1*r*2 and different timings of Td1 ranging from resonating timing (Td=2.3 (μs)) to oscillation-damping timing (Td=1.0).

The ink residue, which is denoted by 804 in FIGS. 9 and 10, is ink that returns toward the head after break-off of an ink column but remains on a surface of the nozzle rather than returning to inside the nozzle. An ink residue can adversely affect an image because an ink residue can cause mist or the like to be produced at ink ejection. Therefore, it is desirable to minimize ink residues.

As the temperature drops, the satellite becomes longer, but the ink-residue deposition probability decreases. As the temperature increases, the satellite becomes shorter, but the ink-residue deposition probability increases. Independent of the temperature, the closer the timing of Td1 to the resonating timing, the greater the satellite shortening effect; the larger the crest value Vr2, the greater the satellite shortening effect. However, in this condition, the ink-residue deposition probability is high. The lower the temperature, the smaller the dependence of the ink-residue deposition probability on Td1. In a range where the crest value Vr2 is higher than a certain value (approximately 8 V in the first implementation example), the ink-residue deposition probability increases sharply. This range is assumed as an unusable range.

As illustrated in FIG. 13, an optimum point for attaining both of the satellite shortening and stability (i.e., achieving low ink-residue deposition probability) depends on the temperature. The optimum points, each being one of the three points, are indicated as circled points in FIG. 13. In short, an optimum value is obtained by using characteristic curves measured at different values of Td. More specifically, the optimum value is smallest one of optimum values, each of which corresponds to one of the different values of Td and is at an intersection between a curve of satellite length and a curve of ink-residue deposition probability. In the low-temperature condition, the optimum value is close to Td1=Tc. In the high-temperature condition, the optimum value is close to Td1=½Tc.

According to the first implementation example, in the low-temperature condition where the ink viscosity is high and therefore oscillation damping is high, the second contracting waveform component 1*r*2 is applied near oscillation-exciting timing, which is timing which excites oscillation generated by the first contracting waveform component 1*r*1 . Accordingly, the ink-column trailing-end portion 803 is accelerated, and the meniscus 804 is caused to bulge so that neck formation in the ink column 802 expedites break-off of the ink-column trailing-end portion 803. As a result, intense satellite shortening effect is obtained. Thereafter, by applying the second expanding waveform component 1*f*2 at oscillation-damping timing, residual oscillation of the meniscus is damped. Thus, both of stable ejection and satellite shortening in the low-temperature condition are attained.

In the high-temperature condition where the ink viscosity is low and therefore oscillation damping is low, the second contracting waveform component 1*r*2 is applied near oscillation-damping timing, which is timing at the oscillation generated by the first contracting waveform component 1*r*1 is damped. Accordingly, the residual oscillation of the meniscus is damped, and the meniscus 804 is caused to bulge so that neck formation in the ink column 802 expedites break-off of the ink-column trailing-end portion 803. As a result, an appropriate degree of the satellite shortening effect is obtained.

Thereafter, by applying the second expanding waveform component 1*f*2 at oscillation-damping timing at which the oscillation generated by the first contracting waveform component 1*r*1 is damped, the residual oscillation of the meniscus is further damped. As a result, both of stable ejection and satellite shortening in the high-temperature condition are attained. In the intermediate range between the low temperature and the high temperature, application timing to apply the waveform component 1*r*2 is continuously changed from the resonating timing to the oscillation-damping timing. As a result, both of stable ejection and satellite shortening are attained throughout an entire temperature range.

Thus, it becomes possible to minimize influence on a drive waveform length, perform ejection stably, exhibit favorable frequency characteristics, and eject droplets with fewer satellites without changing waveform configuration even in a condition where the environmental temperature (ink viscosity) varies relatively greatly.

Figure 14:
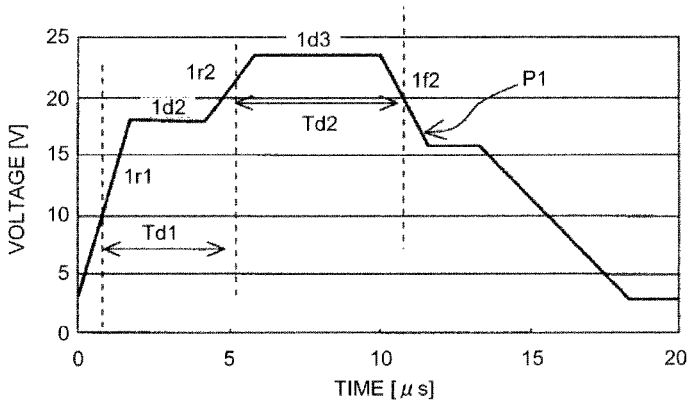
FIG. 14 is a configuration diagram of a drive waveform according to a second implementation example.

FIG. 14 illustrates a waveform configuration according to a second implementation example. A waveform configuration that does not include the waveform component 1*f*1 and starts from the waveform component 1*r*1 as illustrated in FIG. 14 can alternatively be employed.

The image forming apparatus according to the embodiment is not necessarily configured to have only a printing function. The image forming apparatus may have multiple functions, e.g., printer/facsimile/copier functions.

According to an aspect of the embodiment, it is possible to, even in a condition where an environmental temperature varies relatively greatly, eject tiny droplets highly stably with favorable frequency characteristics and with fewer satellites while minimizing an influence on a drive waveform length and waveform configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A droplet ejecting apparatus, comprising:

a recording head including a plurality of nozzles, a plurality of liquid chambers communicating with the respective nozzles and storing ink, and actuators for applying pressure to the respective liquid chambers; and a print control unit configured to generate drive signals for driving the respective actuators to eject droplets from the nozzles, wherein the drive signal includes a first contracting waveform component for ejecting a droplet and a second contracting waveform component for further contracting the liquid chamber after application of the first contracting waveform component but not ejecting a droplet, the second contracting waveform component is set to be output at oscillation-damping timing at which a pressure wave generated by the first contracting waveform component is damped, in a condition where an environmental temperature is high, and the second contracting waveform component is set to be output at resonating timing at which resonance with the pressure wave generated by the first contracting waveform component occurs, in a condition where the environmental temperature is low.

2. The droplet ejecting apparatus according to claim 1, wherein the drive signal further includes an expanding waveform component to be output after the second contracting waveform component, the expanding waveform component being set to be output at oscillation-damping timing at which the pressure wave generated by the first contracting waveform component is damped.

3. The droplet ejecting apparatus according to claim 2, wherein the expanding waveform component causes the liquid chamber to expand before the drive signal is output.

4. The droplet ejecting apparatus according to claim 1, wherein the second contracting waveform component is set to be output at timing proportionally to a change in temperature or viscosity.

5. The droplet ejecting apparatus according to claim 1, wherein a crest value of the second contracting waveform component is constant regardless of the environmental temperature.

6. The droplet ejecting apparatus according to claim 1, wherein viscosity of the droplets to be ejected is in a range of 5 to 20 mPas.

7. A method for driving a droplet ejecting apparatus that includes a recording head including a plurality of nozzles, a plurality of liquid chambers communicating with the respective nozzles and storing ink, and actuators for applying pressure to the respective liquid chambers, and a print control unit configured to generate drive signals for driving the respective actuators to eject droplets from the nozzles, the method comprising:

outputting a first contracting waveform component for ejecting a droplet as a component of the drive signal; and outputting a second contracting waveform component for further contracting the liquid chamber after application of the first contracting waveform component but not ejecting a droplet, as a component of the drive signal, wherein the second contracting waveform component is output at oscillation-damping timing at which a pressure wave generated by the first contracting waveform component is damped, in a condition where an environmental temperature is high, and the second contracting waveform component is output at resonating timing at which resonance with the pressure wave generated by the first contracting waveform component occurs, in a condition where the environmental temperature is low.

* * * * *